United States Patent [19]

Bishop

[11] 4,245,874

[45] Jan. 20, 1981

[54] FLEXIBLE CONNECTOR ASSEMBLY FOR TRACK LIGHTING SYSTEM

[75] Inventor: Walter F. Bishop, Bloomingdale, Ill.

[73] Assignee: McGraw-Edison, Rolling Meadows, Ill.

[21] Appl. No.: 17,177

[22] Filed: Mar. 5, 1979

[51] Int. Cl.[3] ..... H01R 4/66

[52] U.S. Cl. ..... 339/14 R; 339/22 B; 174/70 B; 403/291; 52/220

[58] Field of Search ..... 339/14, 4, 22 B, 23; 174/68, 70, 72, 186; 52/220; 403/291

[56] References Cited

U.S. PATENT DOCUMENTS 2,879,319 3/1959 Carlson et al. ..... 339/22 B

*Primary Examiner*—Roy Lake
*Assistant Examiner*—DeWalden W. Jones
*Attorney, Agent, or Firm*—Ronald J. LaPorte; Jon Carl Gealow

[57] ABSTRACT

A flexible connector assembly for coupling, both mechanically and electrically, sections of electrical distribution track in a track lighting system includes first and second connector segments each having at a first end, a plug-in type tapping mechanism for joining the segments mechanically and electrically to sections of electrical distribution track. A flexible and expandible member formed of a pair of conductive, coiled, wire elements concentrically wrapped in opposite directions with respect to each other, is joined at opposite ends at the second ends, respectively, of the connector segments. The coiled wire elements define a tubular passageway for electrical conductors coupling the connector segments electrically and the member itself provides a ground connection between the connector segments and corresponding track sections. The construction of the flexible member permits the positioning of joined track sections at a variety of angles with respect to each other and protects the electrical conductors passing therethrough between the connector segments.

12 Claims, 9 Drawing Figures

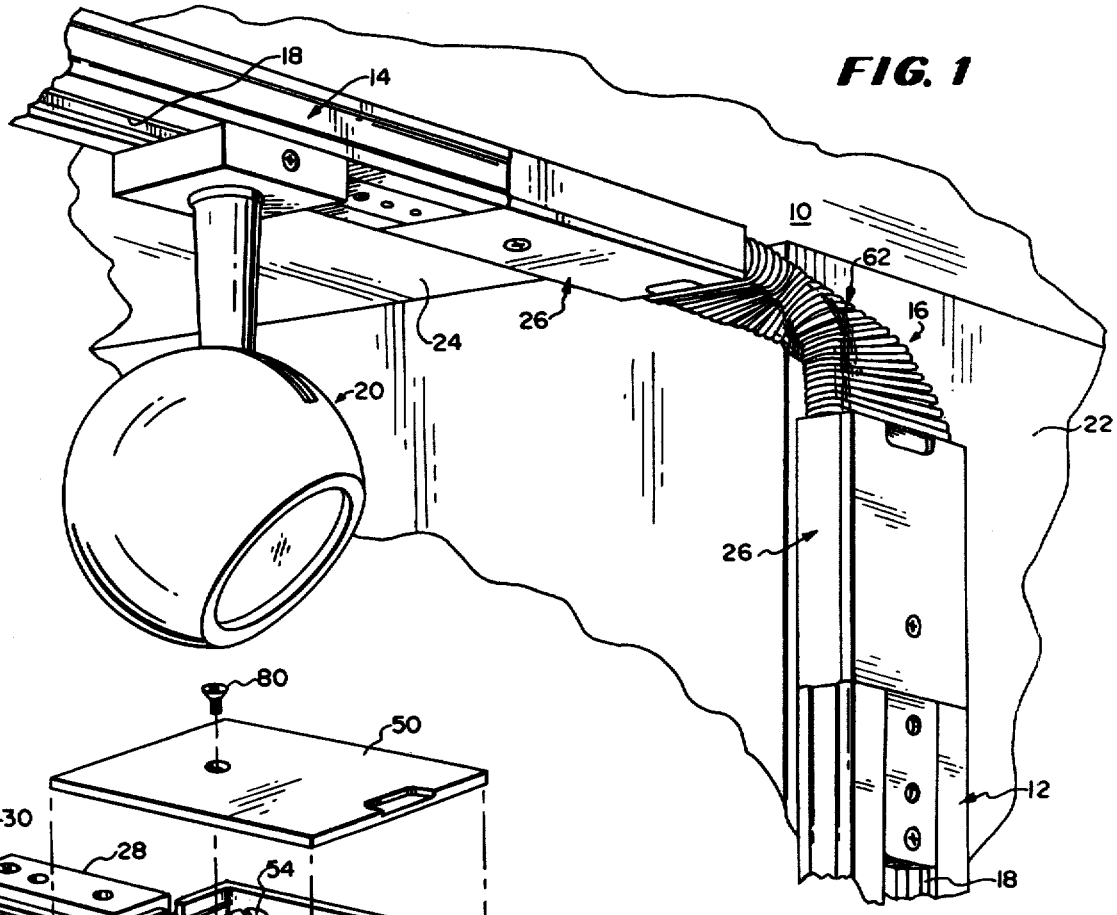
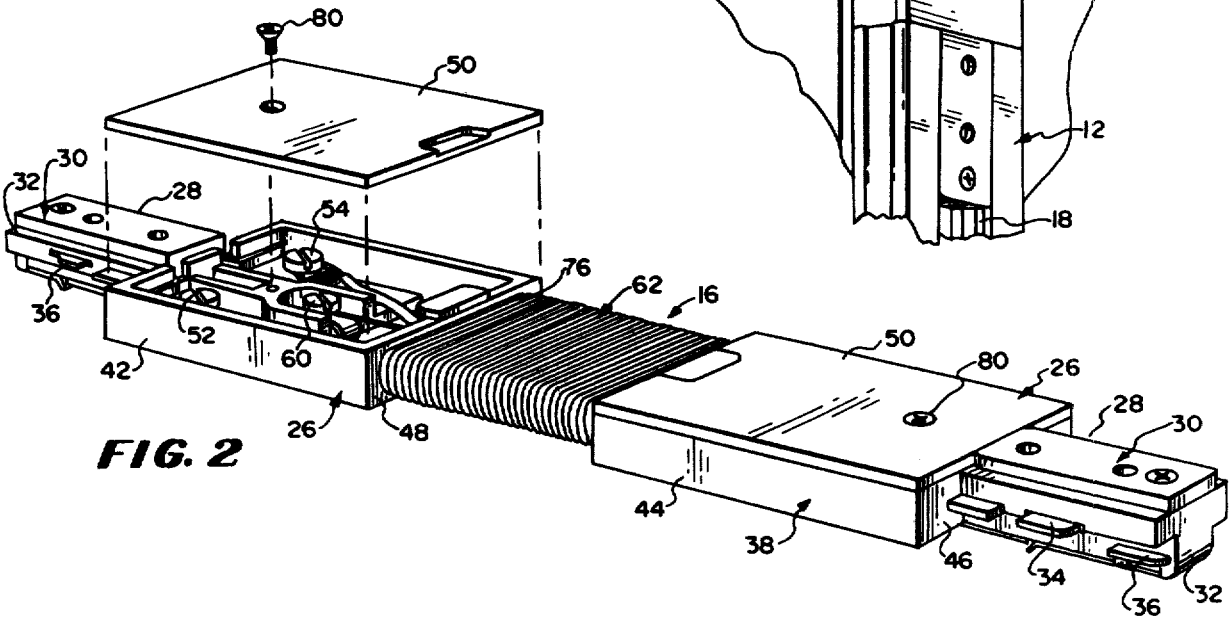
FIG. 2
FIG. 3
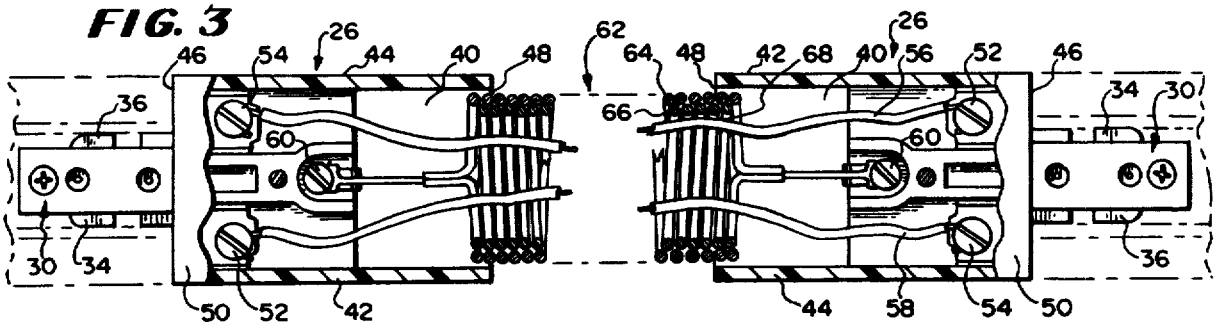

FLEXIBLE CONNECTOR ASSEMBLY FOR TRACK LIGHTING SYSTEM

BACKGROUND OF THE INVENTION

This invention relates generally to electrical connector devices and more particularly to such devices for electrically and mechanically connecting, at a variety of angles with respect to each other, electrified power distribution track sections for track lighting systems.

Track lighting has become very popular in the United States and other countries of the world, both for commercial and domestic use. Its versatility and appearance have contributed heavily to such popularity. The capability to install power distribution tracks in many patterns on wall, ceiling and the like support surfaces, make track lighting desirable for illuminating objects and locations in homes and business establishments. For the most part, however, installation of power distribution tracks to create track patterns had been limited to those having only 90° or straight line connections.

To provide even greater versatility and enhance the effects achievable with track lighting, it was necessary to create distribution track patterns which have track sections mounted at angles other than 90° or in-line. To accomplish the latter, it has been suggested to provide a track section connector which is flexible and therefore capable of joining two straight distribution track sections at various angles.

A flexible track light connector assembly of the above-mentioned type is illustrated in U.S. Pat. No. 4,096,349. The flexible connector assembly of the patent includes a pair of connectors, each of a conventional type, including a tapping mechanism to be snap-fitted into electrical distribution track sections of a track lighting system. The connectors are joined by a length of flexible, elastic, insulative material having a corrugated or accordian appearance, capable of being bent at various angles to in turn direct the sections of distribution tracks joined thereby at various angles with respect to each other. A passageway extends through the length of insulative material to accommodate conductors connecting the track sections electrically.

Because the insulative material comprising the flexible junction is difficult to maintain in a bent condition, it is required that the electrical conductors passing therethrough be of sufficient rigidity to hold the flexible junction in such condition to produce the desired distribution track pattern. Also, because of limited elasticity in the material, provision of unusual bends in the material for positioning the joined track sections at extreme angles with respect to each other, for example, between wall and ceiling surfaces, is difficult to achieve without placing excessive stress on the elastic material. Furthermore, because the flexible junction is formed of an insulative material, an additional separate ground wire must be provided to couple the track sections to ground potential.

Other junction connectors for electrical distribution conduits, not, however, for use in track lighting systems, are known in the prior art, also. One in particular shown in U.S. Pat. No. 2,305,100, includes two elements pivotally joined to provide both mechanical and electrical coupling thereof, to enable one to mount an electrical conduit along the baseboard in a room across both inside and outside corners thereof. This junction connector is limited in its movement and is not suitable for use with track light distribution systems.

SUMMARY OF THE INVENTION

Accordingly, it is a primary object of the present invention to provide a new and improved flexible connector assembly for joining, both mechanically and electrically, sections of power distribution track in a track lighting system, which connector assembly is flexible to permit the positioning of such track sections at a variety of angles with respect to each other, as well as providing a ground connection therebetween.

It is another object of the present invention to provide a flexible connector of the above-mentioned type which is relatively simple in construction and inexpensive to fabricate, yet is effective to create a variety of distribution track patterns for a track lighting system.

Briefly, a preferred embodiment of a flexible connector assembly according to the invention for coupling both mechanically and electrically, sections of electrical distribution track in a track lighting system, includes first and second connector segments, each having at a first end thereof, a plug-in type tapping mechanism for joining the segments to sections of electrical distribution track. The opposite end of each of the connector segments defines an aperture having an elongated shape extending the width of the segment. A flexible and expandible member is formed of a pair of conductive, coiled wires, concentrically wound in opposite directions, to form a channel or passageway for accommodating conductors for electrically connecting the connector segments. Free ends of the coiled wire pair are joined together and pass into a respective connector segment through the aperture defined therein, for connection at the ground terminal thereof, thereby securing the segments in a joined condition mechanically and providing a ground connection between the track sections coupled to the connector segments. The flexible, double coiled wire member permits positioning of the connector segments at a variety of angles with respect to each other and minimizes entry into the passageway defined thereby.

DESCRIPTION OF THE DRAWINGS

In the drawings:

FIG. 1 is a fragmentary, perspective view of a flexible connector assembly according to the invention for coupling, both mechanically and electrically, sections of electrical distribution track of a track lighting system;

FIG. 2 is a partially exploded, perspective view of the flexible connector assembly of FIG. 1;

FIG. 3 is a top, partially sectioned view of the flexible connector assembly of FIG. 2;

DETAILED DESCRIPTION OF THE DRAWINGS

Figure 4:
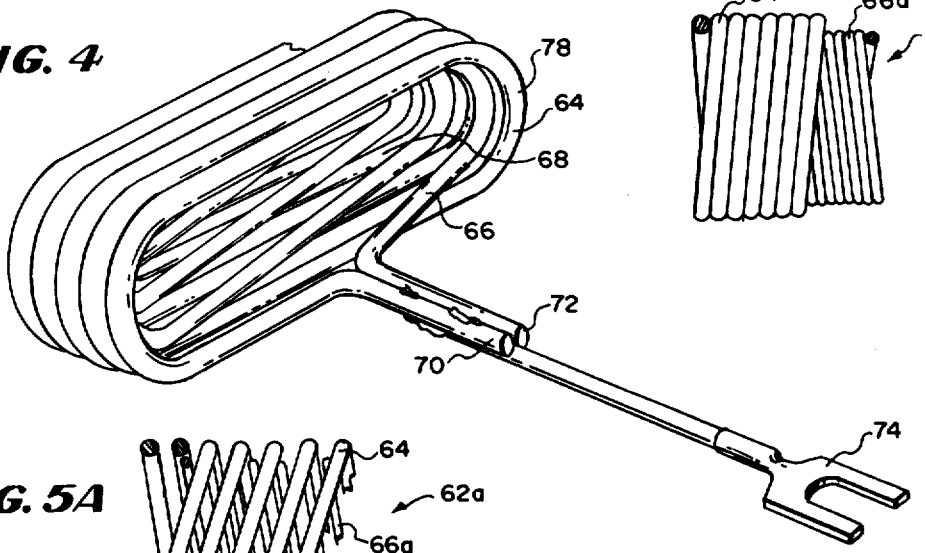
FIG. 4 is an enlarged, perspective view of one end of the flexible and expandible member joining the connector segments of the flexible connector assembly of FIG. 1, illustrating the double concentrically wound, coiled wire construction thereof according to the invention.

Referring now to the drawings in greater detail wherein like numerals have been employed throughout the various views to designate similar components, there is illustrated in FIG. 1, a track lighting system, generally designated by the numeral 10, including first and second electrical distribution track sections 12, 14, respectively, coupled together both mechanically and electrically by a flexible connector assembly 16 according to the invention.

The track sections 12, 14 of the track lighting system are of a conventional type, including a U-shaped housing constructed of extruded aluminum or the like material, with a longitudinally extending aperture 18 for receiving a connector portion (not shown) of a lampholder, such as 20, mounted thereon. Within the interior of the extruded track housing is located a complementarily shaped, elongated insulative insert (not shown) in which electrical conductors (not shown) coupled to a power source, extend. Terminals (not shown) on the connector of the lampholder 20 engage the conductors passing through the insulated insert, upon insertion of the connector into aperture 18, thereby to supply power to the lampholder.

The track sections are mountable on support surfaces such as ceilings, walls and the like. They are secured to such support surfaces with fasteners, such as screws (not shown) extending therethrough. In the case of the track lighting system of FIG. 1, track section 12 is mounted along wall surface 22, while section 14 is mounted on an adjoining ceiling surface 24.

Figure 6:
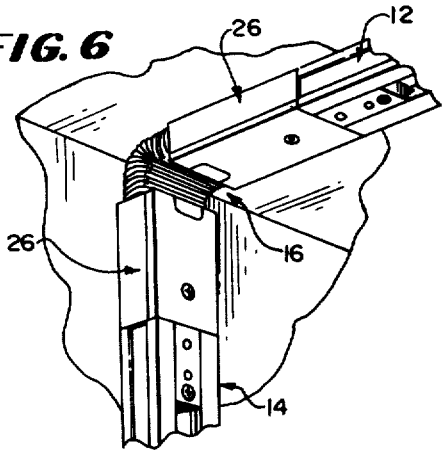
FIGS. 6–8 are perspective views of a flexible connector assembly according to the invention shown coupling, both mechanically and electrically, sections of electrical distribution track in a track lighting system, which track sections are mounted at a variety of angles with respect to each other on different support surfaces.
Figure 7:
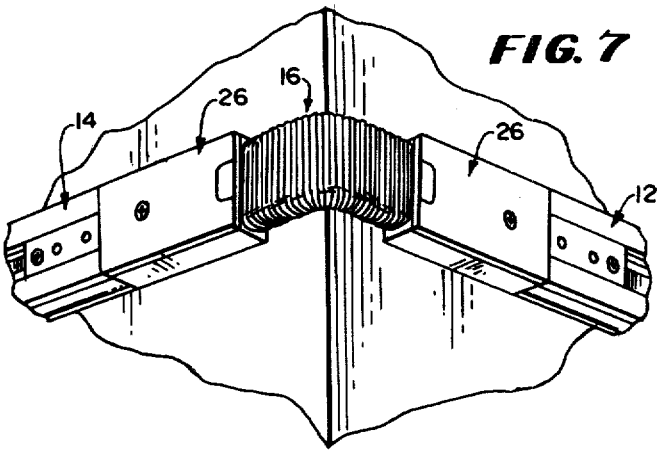
Figure 8:
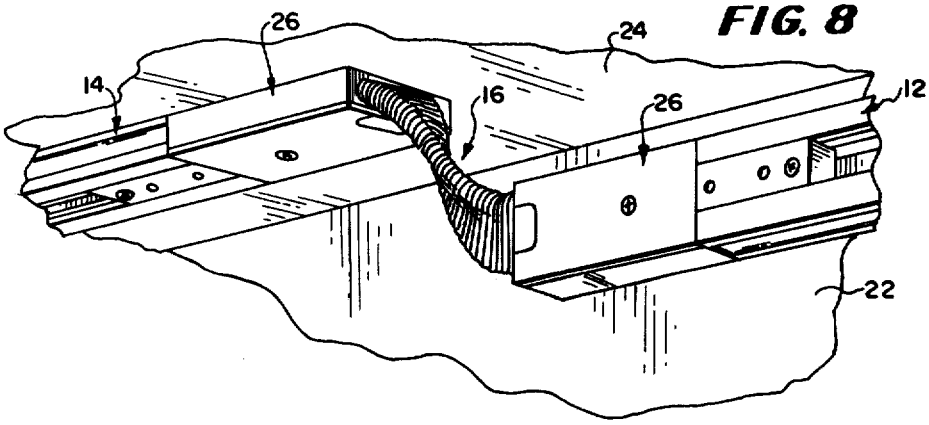

Joining the track sections 12, 14, both mechanically and electrically, is the flexible connector assembly 16, according to the invention. With such assembly, as can be seen in FIG. 1, it is possible to provide a track lighting system pattern extending along a variety of adjoining support surfaces. Examples of other track lighting system arrangements made possible with the flexible connector assembly according to the invention, and which will be discussed hereinafter, are illustrated in FIGS. 6–8 of the drawings.

Turning now to FIGS. 2 and 3 of the drawings, the flexible connector assembly 16 according to the invention includes first and second structurally identical connector segments, each designated by the numeral 26. Each such connector segment is adapted for connection at a first end 28 thereof with a distribution track section of the lighting system, and includes thereat a tapping mechanism 30, including an insulative tongue portion 32 dimensioned for receipt in longitudinal registration, in aperture 18 of a track section 12 or 14. The tapping mechanism further includes spring loaded terminals 34,36, which upon insertion of tongue portion 32 into the track section, engages the power conductors extending therethrough. A third terminal 36 provides a ground connection for the track lighting system.

Each connector segment 26 also includes an enclosed housing portion 38, preferably formed of insulative plastic, integrally with tongue portion 32. In the embodiment illustrated, the housing portion 38 includes a lower wall 40, side walls 42, 44, end walls 46, 48, one, 46, of which is joined integrally with tongue portion 32, and a removably mounted top wall 50.

Within housing portion 38 of the connector segment 26, is provided first and second screw terminals 52, 54, received in tapped holes in the opposite ends of terminals 34, 36, respectively, which extend into the housing portion. The screw terminals permit the connection of electrical conductors such as 56, 58, used to connect electrically the connector segments of the flexible connector assembly 16. A third screw terminal 60 is also provided within the housing portion 38 and is received in a tapped hole in the opposite end of ground terminal 36 which also extends into housing portion 38, for completing a ground connection between the connector segments.

Joining the connector segments, which themselves are rigid in construction, is a flexible, expandible member 62. Member 62 comprises first and second conductive, coiled or helically wound wire elements, 64, 66. The wire elements are wound concentrically in opposing directions to form a predeterminedly dimensioned, tubular passageway 68 through which electrical conductors 56, 58, pass. For aesthetic purposes, the wires are coated with paint or vinyl in a color matching the connector segments and track sections. In a preferred embodiment, such as illustrated in FIG. 3 of the drawings, the diameters of the wire elements 64, 66 are equal, preferably about 0.05 inches.

Figure 5:
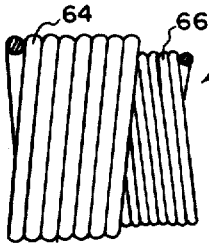
FIGS. 5 and 5*a* are partially cut away side views of an alternative embodiment of a flexible and expandible member included in the flexible connector assembly according to the invention.
Figure 5A:
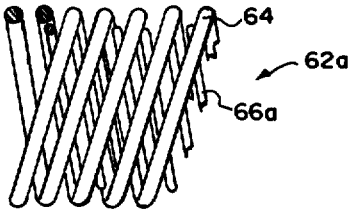

The opposed wrapping of the concentrically wound coiled wire elements 64, 66, produces a transverse overlapping of the concentrically wound elements and thereby minimizes penetration by foreign objects of the tubular passageway 68 formed thereby, since the coils of wire elements fill in the spaces between each other when the flexible member is expanded or bent. Alternatively, the innermost wire element may, if desired, be of a slightly smaller diameter. Such as alternative embodiment **62*a* of the expandible and flexible member is illustrated in FIGS. 5 and 5*a* wherein the outermost coiled wire element 64 is of the same diameter as elements 64, 66 in the embodiment of FIG. 3. Element 66*a* is, however, slightly smaller in diameter, approximately 0.025 inches. The use of the smaller diameter wire elements permits a tighter coil or helix and provides a variation in the degree of expansion of the coiled elements, aiding in minimizing penetration into passageway 68**.

The free ends 70, 72, respectively, of the coiled wire elements are bent at right angles, so that the ends 70, 72, extend longitudinally of the passageway 68. Ends 70, 72 are joined together by welding or soldering. A terminal 74 is also joined thereto.

In the embodiments 62, **62*a* of expandible and flexible conductive members shown and described herein, the helically wound elements thereof form a tubular passageway having an oval cross section. Similarly shaped apertures 76 are defined in the end walls 48 of the housing portions 38 of the connector segments 26. Ends 78 of the member 62, are received in apertures 76 of connector segments 26 with ends 70, 72 of the joined coiled elements extending into the housing portions so that terminal 74 joined thereto is received at screw terminal 60. Screw terminal 60 is tightened down on terminal 74 of the coiled elements to join the flexible member to connector segment 26. The flexible member is joined to both connector segments in the same fasion; i.e. at the ground terminal 60** thereof. The joinder of the conductive flexible member as described serves two purposes; i.e. to mechanically couple the connector segments and to connect them electrically at ground potential. As such, no additional ground wire connection is required for the flexible connector assembly.

Once the electrical conductors 56, 58 are connected between terminals 52, 54, respectively, of the two connector segments included in the flexible connector assembly 16, the assembly is operative to electrically couple distribution track sections joined thereto. The last mentioned connections are made easily, as the interior of housing portion 38 of the connector segment 26 is acessible merely by removal of wall 50 thereof, held to the housing portion by means of a single screw fastener, 80, FIG. 2.

As can be seen in FIGS. 1 and 6–8 of the drawings, the flexibility of member 62 permits the distribution track sections of a track lighting system to be mounted in a variety of orientations with respect to each other. In FIG. 1, wherein track section 12 is mounted in a vertical orientation on a support wall 22 and track section 14 is mounted in a horizontal orientation on ceiling surface 24, the member 52 is easily flexed, twisted and expanded to accommodate the orientation of the track sections. In FIG. 8 wherein the track sections are both mounted horizontally, but on wall 22 and ceiling 24 surfaces, respectively, member 62 is sufficiently flexible and twistable to accommodate such mounting. FIGS. 6 and 7 illustrate additional mounting arrangements for a track lighting system wherein the flexibility and expandibility of member 62 permits ease of mounting of the track sections.

While particular embodiments of the invention have been shown and described, it should be understood that the invention is not limited thereto since many modifications may be made. It is therefore contemplated to cover by the present application any and all such modifications as fall within the true spirit and scope of the appended claims.

I claim:

1. In a flexible connector assembly for electrically and mechanically coupling first and second track sections of a power distribution track for a track lighting system, comprising:

first and second rigid connector segments, each having first and second ends with means at said first ends thereof for connecting said segments, both electrically and mechanically to one of said first and second track sections and a central flexible member for joining said connector segments at said second ends for positioning said track sections at a variety of angles with respect to each other and providing a passageway for electrical conductor means coupling said connector elements electrically, the improvement wherein said central flexible member includes electrically conductive wire means wound helically to form said tubular passageway through which said electrical conductor means pass between said connector segments, said wire means being attached at opposite ends thereof at said second ends, respectively, of said connector segments, to couple said connector segments mechanically and to connect said connector segments electrically at ground potential.

2. A flexible connector assembly as claimed in claim 1 wherein said conductive wire means includes first and second coiled wire elements wound concentrically in opposite directions to form said tubular passageway for said electrical conductor means, thereby minimizing entry between said helically wound first and second coiled wire elements into said passageway.

3. A flexible connector assembly as claimed in claim 2 wherein said second coiled wire element has a diameter slightly smaller than the diameter of said first coiled wire element.

4. A flexible connector assembly as claimed in claim 3 wherein said second wire element is wound inside said first coiled wire element.

5. A flexible connector assembly as claimed in claim 1 wherein each said second end of said rigid connector segments includes an end wall defining an aperture, the shape of which is similar to the cross sectional shape of said flexible member and is dimensioned for receipt of a free end of said member therein, wherein each said rigid connector segment includes ground terminal means for connection to ground potential, and wherein the free ends of said conductive wire means are adapted for connection to said ground terminal means for connecting said segments at ground potential.

6. A flexible connector assembly as claimed in claim 5 wherein each of said ground terminal means of said connector segments comprises a screw mounted in a threaded portion of a conductor terminal and wherein the free end of said conductive wire means includes a looped portion for receipt of said screw, thereby to connect said conductive wire means, both mechanically and electrically to said connector segments.

7. A flexible connector assembly for electrically and mechanically coupling first and second track sections of a power distribution track for a track lighting system, said flexible connector assembly including in combination:

first and second rigid connector segments, each having at a first end thereof tapping means for coupling said segments mechanically and electrically, to a respective one of said first and second track sections, and a central flexible member joining said segments at second ends thereof, said flexible member comprising first and second conductive wire elements, helically wound, concentrically to define a tubular passageway having a pre-determined cross-sectional dimension, through which said electrical conductors coupling said connector segments electrically, pass, said wire elements being attached at opposite ends thereof to said connector segments to couple said segments mechanically and to connect said connector segments electrically at ground potential.

8. A flexible connector assembly as claimed in claim 7 wherein said first and second conductive wire elements are wound in opposing directions with respect to each other to minimize entry of said member into said tubular passageway.

9. A flexible connector assembly as claimed in claim 7 wherein said first wire element of said flexible member is wound within said second wire element and said first wire element has a diameter slightly smaller than that of said second wire element.

10. A flexible connector assembly as claimed in claim 7 wherein the second end of each said connector segment defines an aperture dimensioned complementarily to the cross-sectional dimension of said flexible member for receipt of a corresponding end portion thereof.

11. A flexible connector assembly as claimed in claim 10 wherein said free ends of said first and second wire elements are coupled together and include connecting means for coupling both mechanically and electrically to said connector segments.

12. A flexible connector assembly as claimed in claim 10 wherein each said connector segment includes ground terminal means and wherein said connecting means of said flexible member are coupled thereto, thereby to connect said connector segments at ground potential and to join said connector segments mechanically.

* * * * *